United States Patent [19]

Gidewall et al.

[11] 4,241,558

[45] Dec. 30, 1980

[54] PACKAGING MACHINE

[75] Inventors: Kenneth L. Gidewall, Naperville; James R. Proce, Palatine, both of Ill.

[73] Assignee: C.V.P. Systems, Inc., Lombard, Ill.

[21] Appl. No.: 5,967

[22] Filed: Jan. 24, 1979

[51] Int. Cl.[3] ..... B65B 31/06

[52] U.S. Cl. ..... 53/79; 53/512

[58] Field of Search ..... 53/512, 79, 434

[56] References Cited

U.S. PATENT DOCUMENTS

| | | | |
|---|---|---|---|
| 2,749,686 | 6/1956 | Lorenz et al. | 53/434 |
| 2,963,838 | 12/1960 | Harrison et al. | 53/79 |
| 3,939,624 | 2/1976 | Gidewall et al. | 53/512 |

*Primary Examiner*—Travis S. McGehee

*Attorney, Agent, or Firm*—Allegretti, Newitt, Witcoff & McAndrews

[57] ABSTRACT

Apparatus for packaging articles in a controlled atmosphere, such as one created by a vacuum followed by the addition of gas, such as carbon dioxide, provided within a flexible container having an open end. The packaging apparatus includes a frame and a support one the frame for the flexible container, which is preferably supported within a rigid outer container, to maintain a substantially fixed position for the articles in the flexible container. A fixed elongated member or manifold is mounted on the frame and includes an upwardly and forwardly angled sealing surface. The fixed elongated member cooperates with a movable elongated member or manifold which is operatively mounted on the frame and includes a sealing face which is movable into cooperative relationship with the sealing surface of the fixed manifold. The movable manifold is movable between a position which is spaced from the fixed manifold and a second position which is adjacent or against the sealing surface of the fixed manifold. Vacuum openings are provided in the fixed manifold for holding the flexible container in place, particularly when the movable manifold is spaced from the fixed manifold. A mechanism is provided on the frame for moving the movable manifold between the spaced and adjacent positions relative to the fixed manifold. The manifold moving mechanism includes an over-the-center linkage for holding the movable manifold in the adjacent position. Snorkels or passage members are mounted on the frame for passage through the open end of the flexible container and into the flexible container for the purpose of creating a controlled atmosphere therein. The passage members are sealably positioned between and aligned with the sealing surface and the sealing face when the manifolds are adjacent each other and the snorkels are in the flexible container.

9 Claims, 7 Drawing Figures

2.
96
98
94
20
42
38
146
104
36
64
100
16
62
102
76
56
110
46
72
74
10
2.
108
78
34
28
C
44
18
84
80
B
82
A
12
32
26
14
30
22
24
24

Fig. 2
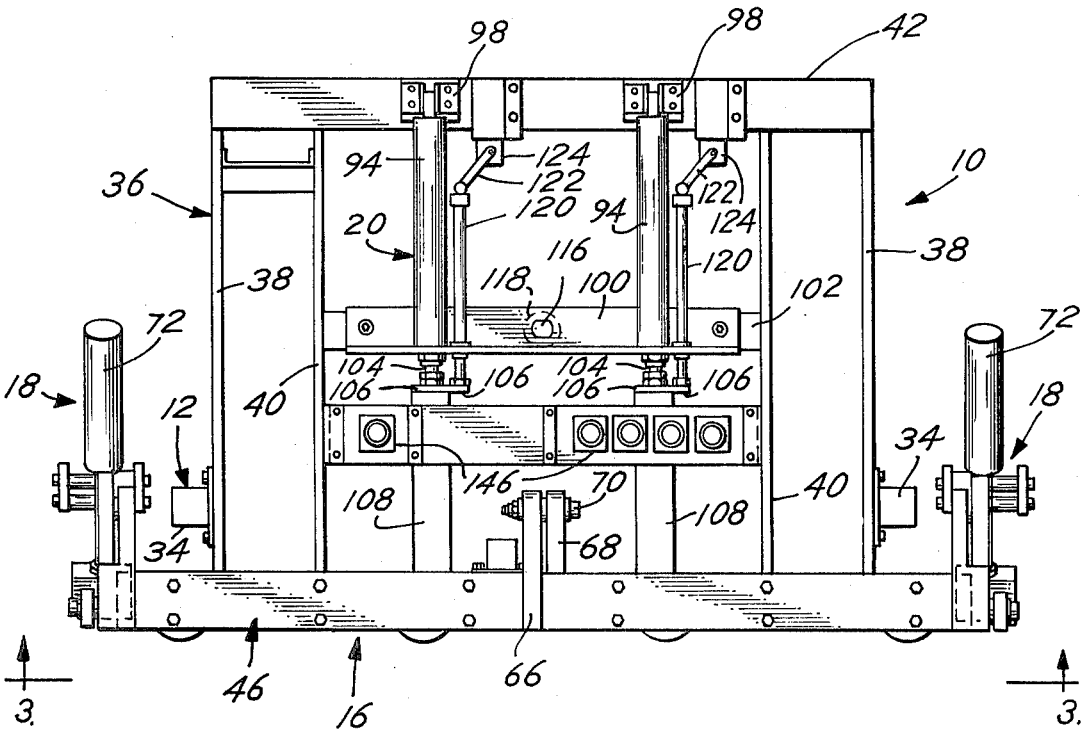
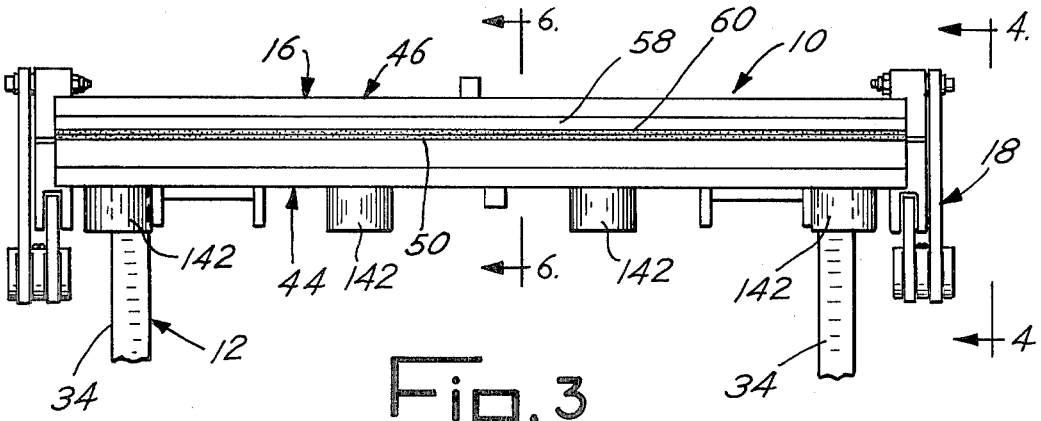
Fig. 3

PACKAGING MACHINE

BACKGROUND OF THE INVENTION

1. Field of the Invention and Description of the Prior Art

This invention relates to an apparatus for packaging articles of various types in a controlled or modified atmosphere created within a flexible container.

There are a large number of materials that are adversely affected by the normal atmosphere, particularly because of humidity conditions and/or the oxygen contained within the air. Such materials includes, but are not limited to, foodstuffs, such as fresh meat, processed meat, fresh and dried fruit, vegetables, nuts, crackers, and fish. Other materials, such as precious metals are similarly affected.

In the case of food products, it is known that the oxygen in the air supports the growth of bacteria on the surface of the meat, particularly under warm temperature conditions. There are a wide variety of vacuumized, gas flushed and/or sealed containers of various types. For example, one of the oldest techniques for preserving food products, is by canning.

Another known way of preserving food products, is the storage of products in flexible bags or containers, which is the type of storage system with which the present invention is involved. Often, the bags are vacuumized. Gas flushing is also known to be used wherein a gas, such as carbon dioxide, is added to the container for actually retarding the growth of bacteria on the stored food.

The known vacuumizing and/or gas flushing systems, particularly for the preservation of foodstuffs, within a flexible container, may be quite broadly classified as being either a "snorkel" type of system or a "chamber" type of system. The present invention is directed to improvements in "snorkel" type systems for creating modified or controlled atmosphere within a flexible container containing various materials, particularly foodstuffs. Representative prior art systems using a snorkel arrangement for creating a vacuum and/or adding the gas into a flexible container containing a variety of materials include Marziani U.S. Pat. Nos. 2,608,333; Feinstein 2,732,988; Kissling 2,840,964; Moore 2,863,267; James 2,888,792; Orsini 2,928,216; Harrison et al 2,963,838; Canfield 3,182,432; Herzmark 3,183,982; Stagmeier 3,289,387; Jianas 3,376,690; and Ludwig 3,430,414. It is to be understood that these patents are only representative of the known prior art.

One commercial machine that has proven to be of significant commerical value is that shown in the Gidewall and Heavner U.S. Pat. No. 3,939,624. Although this machine has proven to be of significant commercial value and is highly versatile in use, as with any commerical equipment, it is almost universally considered to be desirable to reduce costs and to simplify the construction and operation of the equipment, and yet not sacrifice overall performance of the equipment. Although the Gidewall and Heavner Patent discloses a highly useful and successful apparatus, the present invention simplifies and economizes the manufacture of apparatus of the type which is specifically shown in the Gidewall et al patent.

SUMMARY OF THE INVENTION

It is therefore an important object of the present invention to provide an improved packaging apparatus for storing various materials, including food products, within a controlled atmosphere created within a flexible container, wherein the apparatus is more economical than certain prior art devices including that shown in U.S. Pat. No. 3,939,624, the apparatus providing significant cost savings in manufacture and simplification in construction without causing a significant sacrifice in overall performance of the equipment.

It is also an object of the present invention to provide an improved packaging apparatus for storing articles within a controlled atmosphere created within a flexible container wherein the positioning of the open end of the container for the commencement of the operating cycle is highly convenient for the operator.

It is still another object of the present invention to provide a simplified snorkel type of packaging system wherein the snorkels are positioned between a pair of cooperating elongated manifold members wherein only one of the manifold members is movable.

It is still another object of the present invention to provide an improved apparatus for packaging various materials in a flexible container wherein the container is sealed after the creation of a controlled atmosphere by an improved heat seal bar arrangement which is mounted in and readily removable from a fixed elongated manifold member.

It is still another object of the present invention to provide an improved apparatus for packaging articles in a controlled atmosphere container wherein a simplified arrangememt is provided in a fixed manifold for maintaining the open end of the container in position at the commencement of an operating cycle.

Further purposes and objects of the present invention will appear as the specification proceeds.

The foregoing objects are accomplished by providing an apparatus for packaging articles in a controlled atmosphere within a flexible container having an open end, wherein the apparatus includes, in combination, a frame, support member on the frame for supporting the flexible container while the articles therein are in a substantially fixed position, a fixed manifold member mounted on the frame, the fixed manifold having an upwardly and forwardly angled sealing surface, a movable manifold member pivotally mounted on the frame and having a sealing face which is movable into cooperating relationship with the sealing surface on the fixed manifold, the movable manifold being movable between a first positon which is spaced from the fixed manifold and a second position which is adjacent the fixed elongated manifold, vacuum means being provided in the fixed manifold member for holding the flexible container in place when the movable manifold is in the spaced position, an air cylinder and a linkage mounted on the frame for moving the movable manifold between the first and second positions, the linkage means being an over-the-center linkage for positively holding the movable manifold in the second position, a snorkel member mounted on the frame for passage through the open end of the flexible container and into the flexible container for creation of a controlled atmosphere therein, the snorkel being sealably positioned between and aligned between the sealing surface and the sealing face of the two manifolds when the movable manifold is in the second position and when the snorkel is within the flexible container.

BRIEF DESCRIPTION OF THE DRAWINGS

One particular embodiment of the present invention is illustrated in the accompanying drawings wherein:

FIG. 2 is a top view of the embodiment of FIG. 1, taken along the line 2—2 of FIG. 1;

FIG. 3 is an end elevational view of the embodiment of FIGS. 1 and 2, taken along the line 3—3 of FIG. 2;

DETAILED DESCRIPTION OF THE PREFERRED EMBODIMENT

Figure 1:
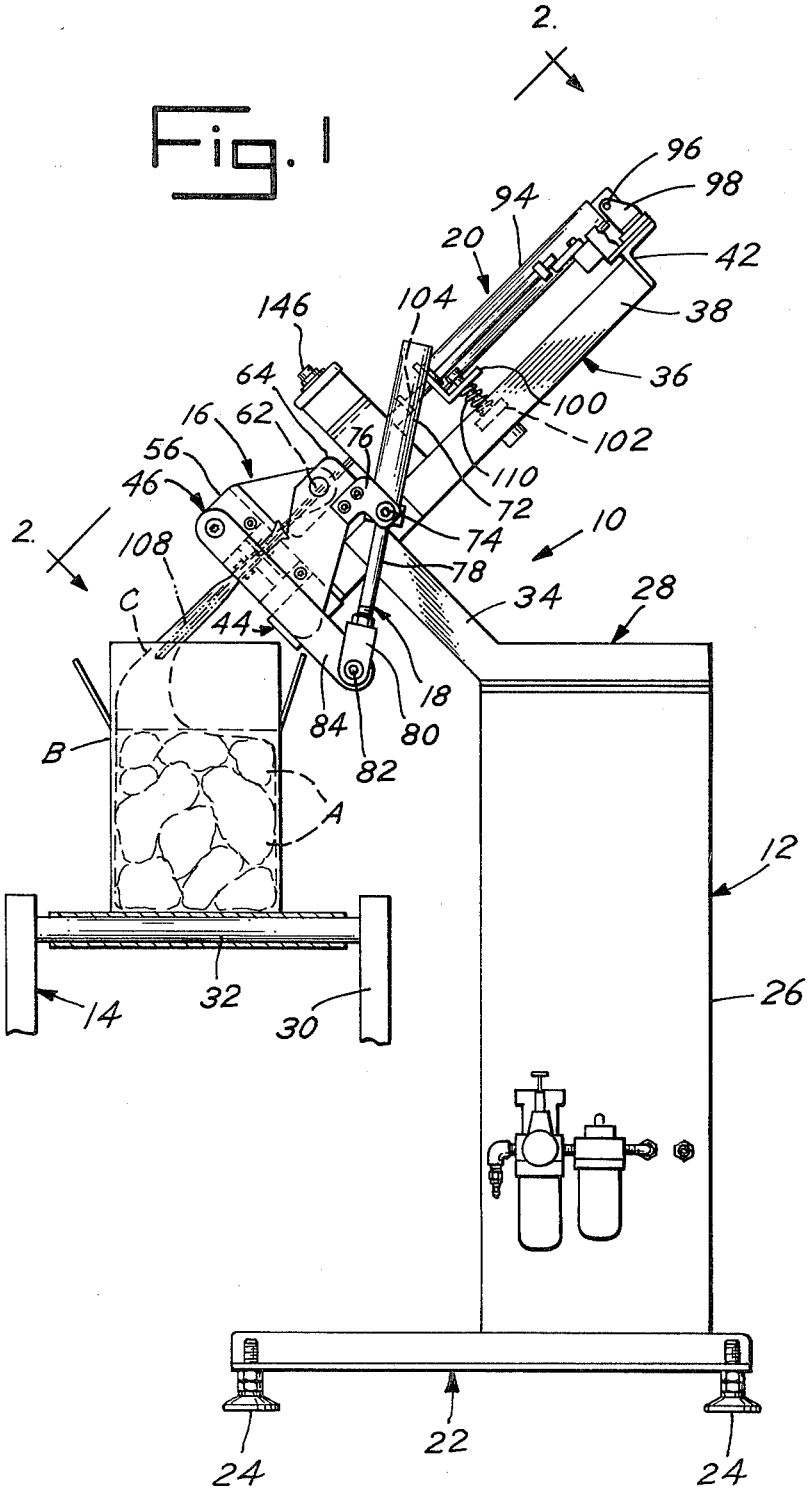
FIG. 1 is a partially broken, side elevational view of one preferred embodiment of our improved packaging apparatus.

Referring to FIG. 1, there is shown one preferred embodiment of our improved apparatus, generally 10, for packaging articles A of various types within a flexible container C in which a controlled or modified atmosphere has been created. Generally, the machine 10 includes a frame, generally 12, a conveyor assembly, generally 14, for supporting the flexible container C with the articles A being packaged therein, a manifold assembly, generally 16, which is positioned in close proximity generally above the container C, an assembly, generally 18, for operating the manifold assembly 16, and a snorkel assembly, generally 20, for insertion into the container C for the creation of the desired modified or controlled atmosphere therein. The articles A may vary over a wide range and may include food products, such as, fresh and processed meats, vegetables, fruit, nuts and non-food products, such as precious metals. The modified atmosphere created by the apparatus 10 may be a vacuum of a desired level, a gas flushed atmosphere, such as carbon dioxide, and a combination of vacuum and gas addition.

The inventive apparatus 10 principally relates to a structure which substantially carries out the process disclosed in the Gidewall and Heavner U.S. Pat. No. 3,939,624. In this regard, the present apparatus 10 uses a snorkel system wherein the snorkel assembly 20 is inserted into the container C, and a vacuum, at a preselected level, is drawn in order to substantially remove the air or oxygen from the container, and a preserving gas, such as carbon dioxide, is added in a preselected amount as determined by the articles A being stored therein. The present specification does not describe the electro-pneumatic circuitry used with the apparatus 10, but reference is made to the Gidewall et al U.S. Pat. No. 3,939,624 for the general type of electro-pneumatic circuitry that can be utilized in order to carry out the various operations of the disclosed apparatus 10.

The machine frame 12 generally includes a lower frame 22 having leveling screws 24 mounted thereon for resting against the floor. The frame 12 further includes a rigid upright housing 26 mounted on the rear portion of the lower frame 22 and which extends upwardly from the lower frame 22. The housing 26 contains the various electrical and pneumatic controls used in operating the machine 10. As indicated previously, the present specification does not describe the pneumatic and electrical controls used with the present apparatus 10.

An upper support frame section 28, mounted on the top of the housing 26, rigidly supports the manifold assembly 16, the manifold operating assembly 18 and the snorkel assembly 20, in a fixed and/or operative position relative to the frame 12 and to the conveyor assembly 14. The conveyor assembly 14 includes upright frame 30, shown in broken view in FIG. 1, which carries a plurality of horizontally positioned conveyor rollers 32 of conventional design. The rollers 32 carry the outer rigid container or box B, such as a corrugated box container, which supports the flexible container C which, in turn, receives the articles A, such as food products, to be packaged in the controlled or modified atmosphere.

The upper support frame section 38, rigidly secured to the upper surface of the housing 26, includes a pair of laterally spaced rigid, upwardly angled support arms 34 which are adjustably connected to a rigid support frame 36 which operatively carries the manifold assembly 16, the manifold operating assembly 18, and the snorkel assembly 20 so that the relative angular position of the frame 36 relative to the arms 34 may be varied. As seen in FIG. 2, the spaced support arms 34 are secured to each of a pair of rigid outer support bars 38 which, as seen in FIG. 1, form part of the frame 36 and extend downwardly and forwardly relative to the container C contained within the box B. The support frame 36, in addition to the outer bars 38, further includes a pair of spaced, inside support bars 40 and a rigid rear cross support 42 which is rigidly secured to the rear ends of each of the support bars 38 and 40. The front, lower end of the downwardly and forwardly angled support frame 36 is rigidly secured to the manifold assembly 16.

Figure 4:
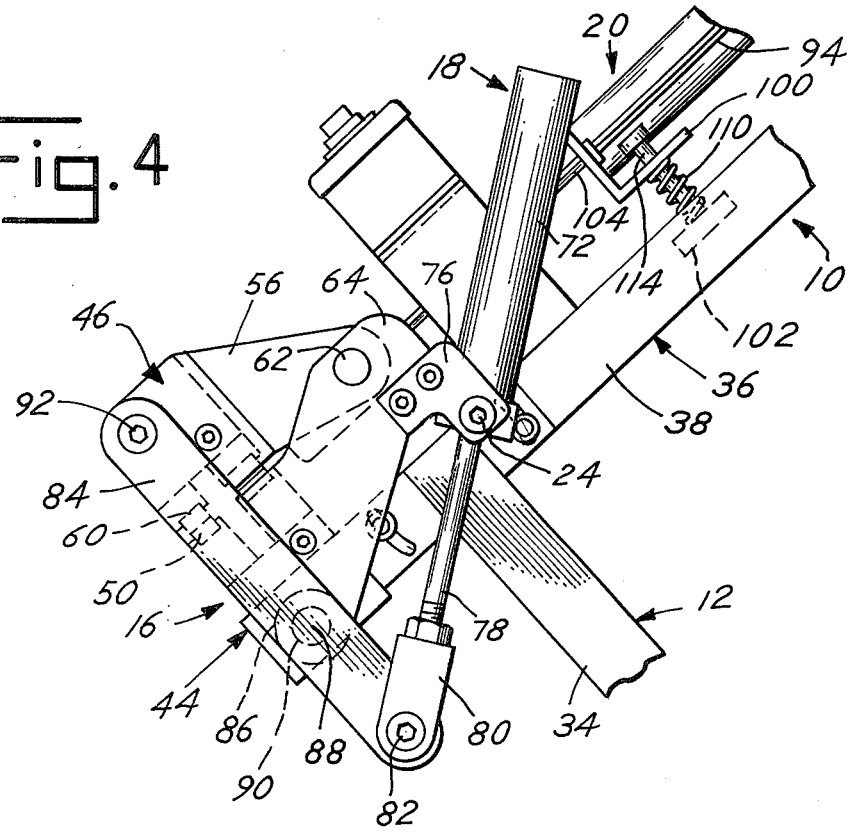
FIG. 4 is an end elevational view of the apparatus embodied in FIGS. 1-3, taken along the line 4—4 of FIG. 3, showing the manifold in the closed position.
Figure 5:
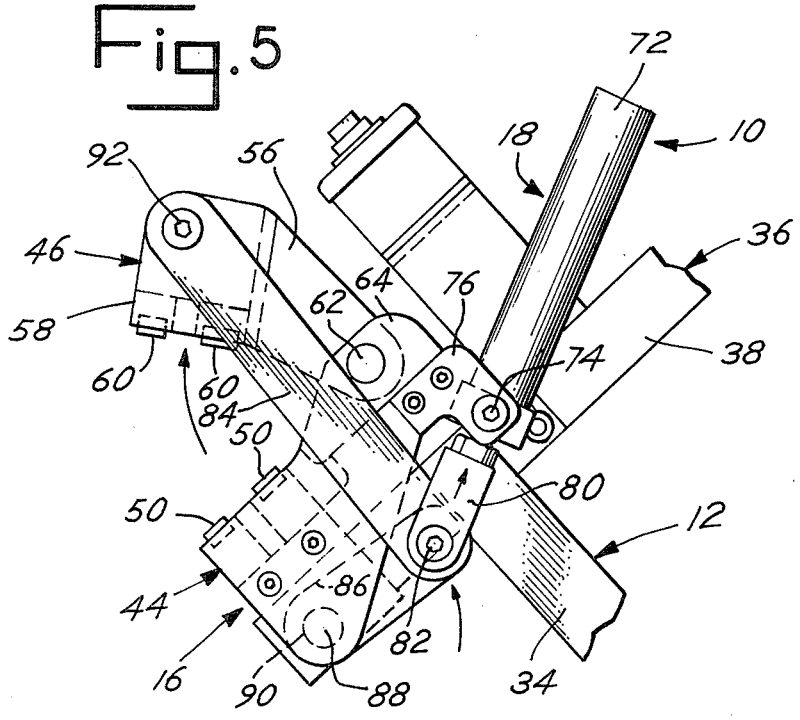
FIG. 5 is an end elevational view of an inventive apparatus, similar to FIG. 4, except the elongated manifold members are shown in the opened position.
Figure 6:
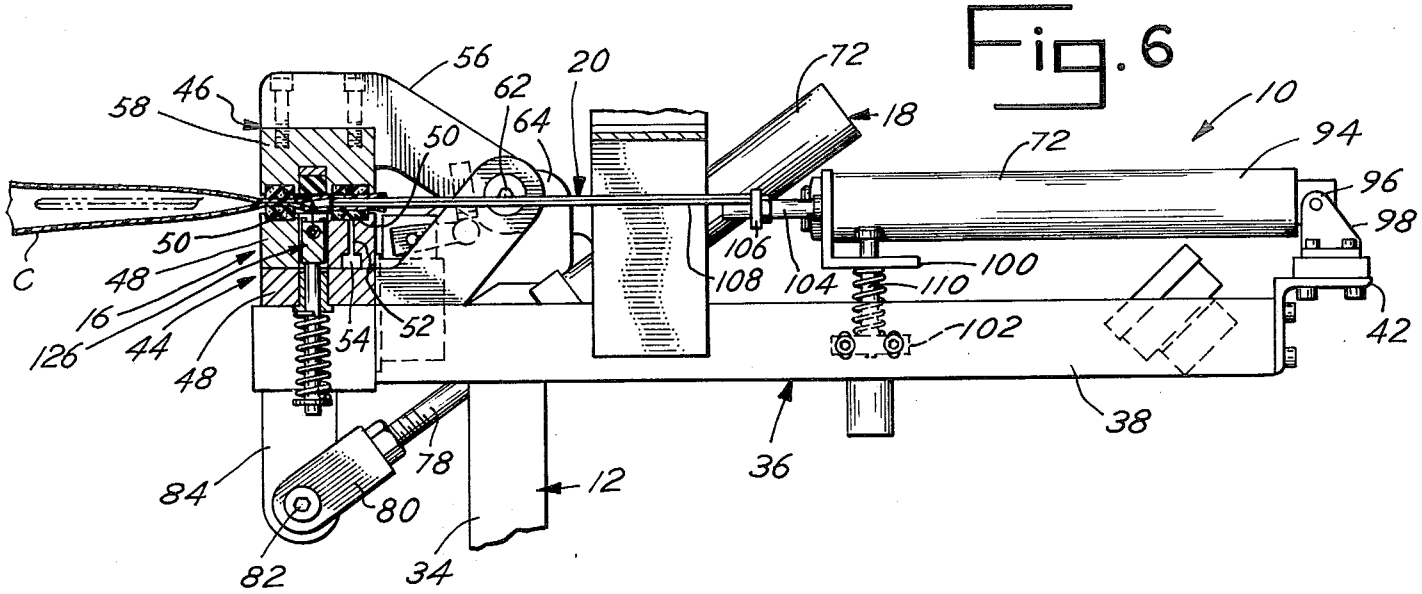
FIG. 6 is a sectional view of the embodiment of FIGS. 1-5, taken along the line 6—6 of FIG. 3, showing the manifold in the closed position.
Figure 7:
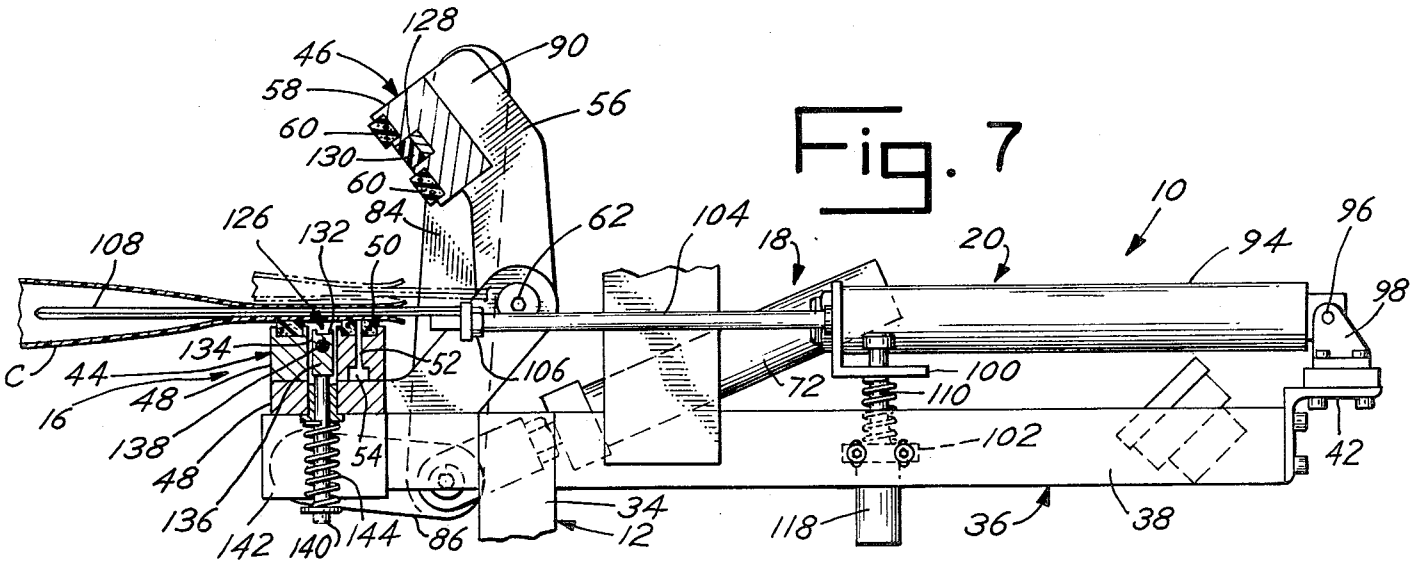
FIG. 7 is a view similar to FIG. 6 except the movable manifold is shown in the spaced position from the fixed manifold.

Referring particularly to FIGS. 4, 5, 6 and 7, the manifold assembly 16 includes a fixed lower, elongated rigid manifold 44 and movable, upper rigid manifold 46 which is movable between open and closed positions. Referring to FIGS. 6 and 7, the fixed manifold 44 includes a pair of contiguous rigid, elongated bars 48 which are rigidly and transversely interconnected to the forward ends of the bars 38 and 40 of the support frame 36. The outer face of the manifold bar 38 has a pair of elongated, resilient, spaced sealing pads 50 secured thereon. The upper, rear sealing pad 50 and contiguous portions of the manifold bar 38 includes a plurality of spaced vacuum openings 52 which interconnect with an elongated channel 54 in the manifold bar 48. The channel 54 communicates with a vacuum source from the housing 26 and generally is interconnected to a vacuum supply. As will be described hereinafter in greater detail, the vacuum openings 52 act to hold the flexible container C in place at the commencement of the operating cycle. In this regard, referring to FIG. 1, the pair of sealing pads 50 define a sealing surface which is angled in an upwardly facing direction towards the operator so that it is convenient for the operator to grasp the open end of the flexible container C and conveniently place the open end of the bag in a substantially wrinkle-free condition against the sealing pads 50 so the vacuum openings 52 hold the flexible bag or container C in place so the operator can commence the operating cycle.

The movable manifold 46 is operated by the operating assembly 18 which includes a pair of spaced outer rigid arms 56. The outer arms 56 are rigidly secured to the opposite outer ends of the manifold bar 58 of the movable manifold 46. As with the fixed manifold assembly 44, the movable manifold 46 includes a pair of sealing pads 60 which are similar to the sealing pads 50 and which are carried by the movable manifold 46, into cooperative relationship with the sealing pads of the fixed manifold 44.

The outer rigid arms 56 act as pivot arms that are pivotally carried by a transverse pivot rod 62 which, in turn, is mounted on upstanding supports 64 mounted on the fixed manifold assembly 44. In addition, the movable manifold 46 includes a central arm 66, as seen in FIG. 2, which is pivotally connected to a central support 68, which is secured to the fixed manifold 44, at the central portion thereof. A pivot rod 70, aligned with the pivot rod 62, pivotally interconnects the arms 66 to the central support 68.

The operating assembly 18 for the manifold assembly 16 further includes a pair of air operated drive cylinders 72 which are pivotable about a transverse support rod 74 carried on a support plate 76 which, in turn, is secured to each of the end supports 64 at the opposite ends of the fixed manifold assembly 44. Each air cylinder 72 includes a reciprocal piston rod 78 having a support bracket 80 mounted at the outer end thereof. Again, as seen best in FIGS. 4 and 5, each bracket 80 for each of the cylinders 72 includes a pivot shaft 82 which pivotally carries an elongated rigid link 84 and a foreshortened rigid link 86. The opposite ends of the elongated links 84 are pivotally secured to the opposite outer ends of the movable manifold assembly 46 and the opposite or outer ends of the foreshortened links 86 are pivotally carried about an axis 88 of a pivot shaft 90 mounted at the opposite outer ends of the fixed manifold member 44.

Referring to FIG. 5, the manifold assembly 16 is shown in the open position and, in FIG. 4, the assembly 16 is shown in the closed position. In FIG. 4, in the closed position, it is important to note that the links 84 and 86 provide an over-the-center linkage, that is, pivot axis 88 is spaced slightly transversely outwardly of an imaginary line interconnecting the axis of the pivot shaft 82 and the pivot axis 92 at the outer end of the elongated link 84. This over-the-center linkage provides for a positive and rigid locking of the movable manifold 46 relative to the fixed manifold 42 in a highly simple and effective manner of construction.

Referring to FIGS. 2, 6 and 7, the snorkel assembly 20 includes a pair of transversely aligned pneumatic drive cylinders 94. As seen best in FIG. 1, the drive cylinders 94 extend downwardly and forwardly and the rear ends thereof are pivoted about a pivot axis 96 provided by support brackets 98 which are mounted on the rear cross support 42. The forward ends of the drive cylinders 94 are rigidly interconnected to a transverse support 100. It is seen that the two pneumatic drive cylinders 94 and the rigid elongated transverse support 100, together with the pivot support brackets 98, define a rigid pivotal frame for the drive cylinders 94 and thereby for the entire snorkel assembly 20.

As seen best in FIG. 2, a transverse support 100 is aligned directly above a rigid intermediate support 102, which is spaced intermediate the support 42 and the fixed manifold 44.

As seen in FIGS. 6 and 7, each of the drive cylinders 94 includes a reciprocal piston rod 104, which includes a support 106 at the outer end thereof for rigidly connecting each piston rod 104 to a hollow snorkel member 108.

The snorkels 108 are constructed in a manner similar to that shown in Gidewall et al U.S. Pat. No. 3,939,624. Each snorkel 108 has a hollow interior and includes openings (not shown) in the outer ends thereof. Lines (not shown) extend from the hollow interior of each of the snorkels 108 for passage to a vacuum source and/or pressurized gas source, such as a carbon dioxide supply. Again, this construction is shown in the said Gidewall et al patent. Each of the snorkels 108 is inserted into flexible container for the drawing of a vacuum and/or for the addition of a gas into the flexible container C in a manner to be hereinafter described in greater detail.

Referring to FIGS. 2, 6 and 7, the snorkel assembly 20 is normally pivotally biased or urged upwardly about the pivot axis 96 so that the snorkels are in a position substantially as shown in FIG. 7, that is, slightly spaced above the sealing pads 50 of the lower, fixed manifold 44. The slight pivoted raising of the snorkel assembly 20 is accomplished by the use of springs 110 positioned between the intermediate support 102 on the frame 36 and each of a pair of brackets 112 provided on the outer ends of the drive cylinders 94. Each spring 110 is guided around an upright guide rod 114 mounted on a bracket 112.

Referring to FIGS. 2 and 7, a central upright stud 116 is aligned between the guide rods 114 and between the cylinders 94 and is operatively interconnected to an upright air cylinder 118 which acts against the springs 110 to pivot the snorkel assembly 20 downwardly to the solid line position of FIG. 7, that is, to a position such that the snorkels 108 are pulled substantially against the sealing pads 50 of the lower or fixed manifold 44. This movement is carried out after the flexible container C has been appropriately positioned, manually, on the lower or fixed manifold 44 and the ends of the snorkels 108 are partially inserted into the container C, as seen best in the hidden line view of FIG. 7. The air cylinders 94 move the snorkels 108 longitudinally so that the outer ends of the snorkels 108 are aligned with the uppermost of the sealing pads 50, when in one position, and in a second position, the ends of the snorkels 108 are moved inwardly into the flexible container C.

As seen in FIG. 2, an adjustable rod 120 is mounted adjacent each of the cylinders 94 and is fixed to the support 100 at the forward end thereof. The rearward end of each of the rods 120 is aligned with the end of a pivot arm 122 of a limit switch 124 mounted on the rear cross support 42 of the support frame 36.

A heat seal assembly 26 is operatively carried by the manifold assembly 16. The upper or movable manifold 46 includes a central channel 128 intermediate the sealing pads 60. A heat seal backup pad 130 is securely received within the channel 128.

The fixed manifold 44 includes a heat seal bar assembly 132. The heat seal bar assembly 132 is reciprocally mounted within a central channel 134 positioned between the sealing pads 50 in the fixed manifold 44. The heat seal bar assembly 132 includes a heatable elongated bar 136 which is reciprocal within the channel 134 and a heat element rod 138 which is imbedded in the bar 136. The opposite or outer ends of the rod 138 are connected to an electrical source (not shown) which heat the rod 138 and thereby the bar 136 to a desired level for slightly melting the generally plastic open outer end of the flexible container C to thereby provide a heat seal after the desired vacuum level, and/or gas at a preselected pressure, has been added to the interior of the container C through snorkels 108. The bar 136 and rod 138 are moved in and out of the channel 134 for easy replacement. Forward or sealing movement is imparted to the bar 136 by action of a plurality of piston rods 140 reciprocally mounted in each of a plurality of pneumatic cylinders 142. Each of the cylinders 142 is transversely mounted on the lower side of the fixed manifold assembly 44. Springs 44 mounted on rod 144 normally bias the rods 140 and thereby the bar 136 to the retracted position, as seen in FIG. 6.

Although it is believed that the foregoing provides a description of the inventive apparatus 10, in order that the invention may be even more clearly understood, a brief description of the apparatus 10 will be provided hereinafter.

First, referring to FIG. 1, it is important to note that the lower or fixed manifold 44 faces angularly upwardly towards the operator. The upper end of the flexible container C, which is contained within the corrugated box B, containing the articles A, is at a convenient height for manual manipulation as the operator stands on the floor in front of the machine assembly 10. It is seen that when the upper or movable manifold 46 is in the raised position, as seen in FIGS. 5 and 7, the upper face of the fixed manifold 44 faces angularly upwardly towards the operator and the structure provides a convenient position for receiving the upper end of the flexible container C for the commencement of a cycle of operation.

Referring to FIG. 7, the movable manifold 46 is in the raised or spaced position from the fixed manifold 44. The snorkels 108 are in the retracted position, shown in hidden line view in FIG. 7. In this position, the outer ends of the snorkels 108 are aligned above the upper sealing pad 50 on the fixed manifold 44 and the snorkel assembly 18 is pivoted upwardly so the manifolds 108 are spaced slightly upwardly from the pads 50. The operator then stretches the open end of the container C into a substantially wrinkle free condition and the open end of the bag is passed around each of the snorkels 108. The lower side of the flexible container C is placed against the pads 50 and against the vacuum openings 52.

When the substantially wrinkle free open end of the container C is in position against the vacuum openings 52, an increase in the vacuum level of the system detects that the bag is in place and the air cylinders 94 are activated to move the snorkels 108 downwardly into the flexible container C, and to the solid line position shown in FIG. 7. At the same time, the air cylinder 118 is activated to pivot the snorkel assembly 20 downwardly towards the pads 50 of the fixed manifold 44 so that the bottom panel or side of the container C is trapped between the snorkels 108 and the pads 50. When this occurs, the operator activates two switches in the switch bank 146 seen in FIG. 2, to cause the upper or movable manifold 46 to be pivoted downwardly by activation of the air cylinders 72. It is seen, from FIGS. 4 and 5, that activation of the cylinders 72 pivots the upper or movable manifold 46 downwardly about the pivot axis 62. At the same time, the links 84 and 86, acting as an over-the-center linkage, cooperate to forceably move the movable manifold 46 against the fixed manifold 44 and, with the over-the-center linkage, the movable manifold 46 is locked relative to the fixed manifold 44.

With the movable manifold 46 in place against the fixed manifold 44 and with the manifolds 108 inserted downwardly into the container C, a temporary seal is provided for the interior of the bag C by the sealing pads 50 on the fixed manifold 44 and the sealing pads 60 on the movable manifold 46. Because the pads 50 and 60 are resilient, they form around the flattened snorkels 108 so that the ends of the snorkels 108 are temporarily sealed within the container C. In a known manner, such as found in the Gidewall et al U.S. Pat. No. 3,939,624, a vacuum to a desired level, such as 28" Hg, is drawn within the container C. Particularly in the case of fresh meat or poultry, carbon dioxide is added, at a desired level, to the interior of the container C until the container C is in relatively relaxed condition. As seen in hidden line view in FIG. 6, the snorkels 108 are within the bag C with the manifolds 44 and 46 in the closed position and with the snorkels 108 inserted into the container C.

After the desired vacuum has been drawn and a gas, such as carbon dioxide, has been added to the container C to create the substantially relaxed condition for the walls defining the container C, the internal pressure of the container C is detected, activating switches (not shown) which activate the cylinders 94 of the snorkel assembly 20. The drive cylinders 94 cause the snorkels 108 to be withdrawn to the start position which, again, is in substantial alignment with the upper, rear pair of cooperating sealing pads 50 and 60 as seen in full line view in FIG. 6. At this time, temporary seals 50 and 60 maintain the container C interior at the desired modified or controlled atmosphere. When the cylinders 94 have been withdrawn to their full withdrawn position, as detected by the limit switches 124, there is activation of the heat seal cylinders 142 which drive the rods 140 forwardly to thereby move the heat sealing bar 136 forwardly so that heat is applied for a preselected time for heat sealing of the open end of the container C. After a preselected time interval, the desired permanent or self-sustaining seal has been provided along the open end of the container C.

The cylinders 72 are activated to cause reverse movement of the movable manifold 46 to the upper or raised position relative to the fixed manifold 44. At the same time, the cylinder 118 pivots the snorkel assembly 120 slightly upwardly so that the snorkels 108 are raised from the fixed manifold 44. Also, the vacuum to the vacuum openings 52 is cut so that the bag B may be released from the vacuum created by the vacuum openings 52. The operator then removes the sealed container C, having the controlled atmosphere therein and a subsequent cycle of operation is ready to be commenced.

While in the foregoing there has been provided a detailed description of one particular embodiment of the present invention, it is to be understood that all equivalents obvious to those having skill in the art are to be included within the scope of the invention, as claimed.

What we claim and desire to secure by Letters Patent is:

1. Apparatus for packaging articles in a controlled atmosphere within a flexible container having an open end, said apparatus comprising, in combination, a frame, means on said frame for supporting said flexible container with said articles therein in a substantially fixed position relative to said frame, a fixed elongated member mounted on said frame and having an upwardly angled sealing surface, a movable elongated member operatively mounted on said frame and having a sealing face movable into cooperative relationship with said sealing surface of said fixed elongated member, said movable elongated member being movable between a first position which is spaced from said fixed elongated member and a second position which is adjacent said fixed elongated member, means operatively carried by said fixed elongated member for holding said flexible container in place when said movable elongated member is in said first position, means mounted on said frame for moving said movable elongated member between said first and second positions, said moving means including over-the-center linkage means for holding said movable elongated member in said second position, passage means on said frame for passage through said open end of said flexible container into said flexible container for creating said controlled atmosphere, means for moving said passage means from a first position which is positioned slightly in said open end of said container and a second position which is inserted substantially into said container, said passage means being sealably positioned between and aligned with said sealing surface and said sealing face when said movable elongated member is in said second position and said passage means is in said second position in said flexible container.

2. The apparatus of claim 1 wherein said movable elongated member is pivotally mounted on said frame relative to said fixed elongated member, said movable elongated member being pivotally moved by said moving means for movement of said movable elongated member between said first and second positions.

3. The apparatus of claim 1 wherein said sealing surface faces angularly for convenience and placement of said flexible container open end in a substantially wrinkle free condition while said flexible container holding means operates to hold said flexible container in place against said fixed elongated member.

4. The apparatus of claim 1 including means for moving said passage means between a first position which is slightly spaced away from said sealing surface and a second position which bears against said sealing surface.

5. The apparatus of claim 1 wherein said moving means includes air cylinder means.

6. The apparatus of claim 1 including means for sealing said flexible container after said controlled atmosphere is created.

7. The apparatus of claim 6 wherein said sealing means comprises heat sealing means carried by said fixed elongated member and said movable elongated member for sealing said container along said open end.

8. The apparatus of claim 7 wherein said heat sealing means includes a heat sealing bar carried between retracted and sealing positions in said fixed elongated member and including air cylinder means for moving said heat sealing bar between said retracted and sealing positions.

9. The apparatus of claim 8 including means for normally biasing said heat sealing bar to the retracted position.

* * * * *